United States Patent [19]

Cohen

[11] 4,228,548

[45] Oct. 21, 1980

[54] ATHLETIC GLOVE

[76] Inventor: David L. Cohen, 6517 Tower Dr., Apt. T-3, Alexandria, Va. 22306

[21] Appl. No.: 891,135

[22] Filed: Mar. 28, 1978

[51] Int. Cl.[2] ..... A41D 19/00; A43D 5/00

[52] U.S. Cl. ..... 2/161 A; 273/54 B

[58] Field of Search ..... 2/161 A, 159, 16, 161 R; 273/54 B, 189 A, 89 B

[56] References Cited

U.S. PATENT DOCUMENTS

| | | | |
|---|---|---|---|
| 2,794,638 | 6/1957 | Risher et al. | 2/161 A X |
| 3,728,738 | 4/1973 | Andolino | 273/54 B X |
| 4,047,250 | 9/1977 | Norman | 2/161 A |

*Primary Examiner*—Doris L. Troutman

*Attorney, Agent, or Firm*—John S. Roberts, Jr.

[57] ABSTRACT

An athletic glove comprises a glove body having a substantially planar configuration and which is adapted to be wrapped about the hand, wrist, and arm portions of an arm extremity. First and second rigid brace members are disposed within pockets formed within the glove body for engaging the interior, palm-side of the extremity portions, as well as the exterior, back side of the extremity portions. The two braces operatively cooperate to rigidify the extremity wrist whereby when the extremity undergoes a particular movement, the hand, wrist, and arm portions thereof move in unison. The second brace member may be bent at a central portion thereof in order to fix the disposition of the wrist at a predetermined inclination, and padded fabric may be secured to the interior surface of the glove body for wearing comfort purposes.

4 Claims, 6 Drawing Figures

ATHLETIC GLOVE

FIELD OF THE INVENTION

The present invention relates generally to athletic gloves, and more particularly to a glove which may be worn by an athlete in order to properly support the athlete's wrist and facilitate the movement of the athlete's hand, wrist, and arm in unison. While the glove of the present invention may be utilized by athletes within a multitude of diverse sports, such as, for example, golf, tennis, racquetball, and the like, it is particularly adaptable for use by a bowler.

BACKGROUND OF THE INVENTION

In order to achieve consistently high scores in bowling, it is indispensable that the bowling ball be properly supported and delivered in accordance with well-known techniques. Such techniques dictate, for example, that the wrist be bent slightly inwardly such that the inner, palm side of the hand is disposed at an angle, with respect to the interior side of the arm, which is less than 180°, and that the wrist be rigidly maintained in this disposition throughout the delivery of the ball. In this manner, a desired amount of spinning action, as well as delivery speed, is able to be imparted to the ball whereby heavy pin action will be generated.

While prior art glove devices have sought to achieve the aforenoted wrist support, such devices appear to lack sufficient means for rigidifying the wrist or fixing the same in the desired disposition. More particularly, the prior art devices are characterized by a rigid support plate which is operatively disposed upon the rear or outer sides of the bowler's hand, wrist, and arm. In this manner, the bowler's wrist is prevented from undergoing outwardly or backwardly bent movements, however, the wrist is nevertheless permitted to move with an undesirable degree of freedom, that is, forwardly or inwardly. As a result, the hand, wrist, and arm do not always move in unison, with a consequent loss in ball delivery control characteristics.

OBJECTS OF THE INVENTION

Accordingly, it is an object of the present invention to provide a new and improved athletic glove.

Another object of the present invention is to provide a new and improved athletic glove which may be worn by different type athletes when performing in their respective sports.

Still another object of the present invention is to provide a new and improved athletic glove which is particularly adaptable for use by a bowler.

Yet another object of the present invention is to provide a new and improved athletic glove which overcomes the various drawbacks or disadvantages of prior art athletic gloves.

Still yet another object of the present invention is to provide a new and improved athletic glove which rigidifies the disposition of the athlete's wrist so as to insure the movement of the athlete's hand, wrist, and arm in unison.

Yet still another object of the present invention is to provide a new and improved athletic glove which is capable of adjustably fixing the athlete's wrist in a predetermined disposition so as to selectively dispose the athlete's hand in a desired position during athletic competition performance.

A further object of the present invention is to provide a new and improved athletic glove which, when worn by, for example, a bowler, will materially enhance ball delivery control characteristics such as, for example, ball spin and delivery speed.

A yet further object of the present invention is to provide a new and improved athletic glove which may be easily applied to and removed from the athlete's hand and arm.

A still further object of the present invention is to provide a new and improved athletic glove which is provided with adjustable fastening means for accommodating the athlete's comfort and performance-fitting characteristics.

SUMMARY OF THE INVENTION

The foregoing and other objects are achieved in accordance with the present invention through the provision of an athletic glove which comprises a glove body having a substantially planar configuration and which is adapted to be wrapped about the hand, wrist, and arm portions of an arm extremity. First and second rigid brace members are disposed within pockets formed within the glove body for engaging the interior, palm-side of the extremity portions, as well as the exterior, back side of the extremity portions. The two braces operatively cooperate to rigidify the extremity wrist whereby when the extremity undergoes a particular movement, the hand, wrist, and arm portions thereof move in unison. The second brace member may be bent at a central portion thereof in order to fix the disposition of the wrist at a predetermined inclination, and padded fabric means may be secured to the interior of the glove body for wearing comfort purposes.

BRIEF DESCRIPTION OF THE DRAWINGS

Various other objects, features, and attendant advantages of the present invention will be more fully appreciated as the same becomes better understood from the following detailed description when considered in conjunction with the accompanying drawings, in which like reference characters designate like or corresponding parts throughout the several views, and wherein.

DETAILED DESCRIPTION OF A PREFERRED EMBODIMENT

Figure 1:
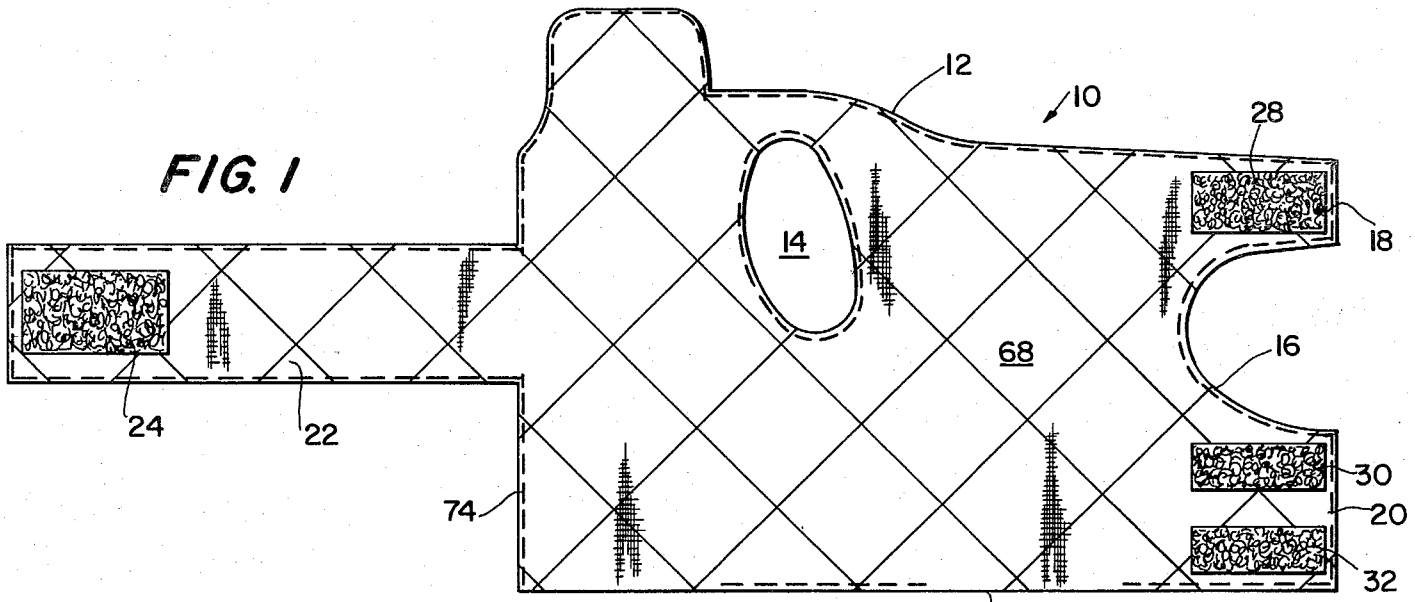
FIG. 1 is a plan view of the interior side of an athletic glove constructed in accordance with the present invention and showing its cooperative parts.
Figure 2:
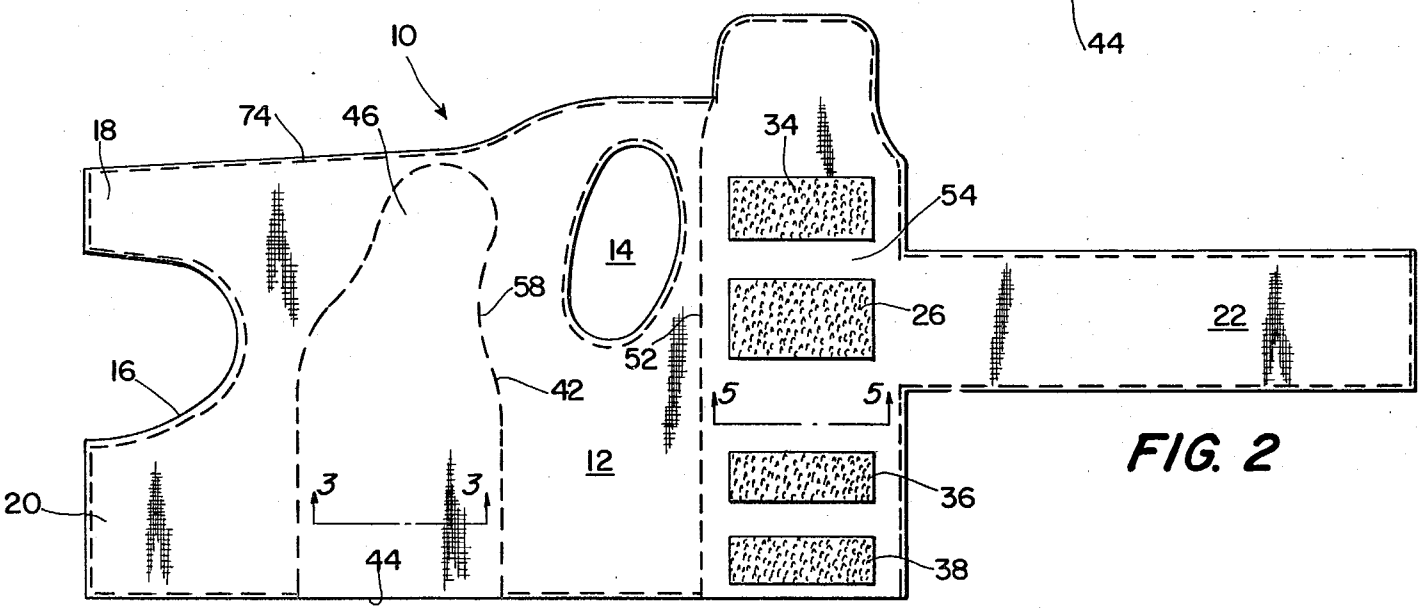
FIG. 2 is a plan view of the exterior side of the glove of FIG. 1.

Referring now to the drawings, and more particularly to FIGS. 1 and 2 thereof, the athletic glove of the present invention is generally indicated by the reference character 10 and is seen to comprise a planar glove body 12 having a substantially rectangular configuration. The body 12 is fabricated from a suitable flexible and resilient vinyl sheet material, such as, for example, NAUGAHYDE, such that when the glove body is to be fitted upon the athlete's hand and arm, the same may be easily wrapped about the hand and arm so as to achieve a contoured fit with respect thereto.

In order to permit the glove body to be secured upon the athlete's hand and arm, the body 12 is provided with an elliptically configured aperture 14, with its major axis inclined somewhat, so as to permit the athlete's thumb to be inserted therethrough. In addition, the body also has a substantially C-shaped cut-out portion 16 defined within one side portion thereof. The cut-out portion 16 serves the dual purpose of defining upper and lower strap members 18 and 20, respectively, and permitting a third strap 22, integrally formed with the opposite side portion of the body 12, to pass therethrough as opposed to being required to overlap excess material of the body 12 which would render the glove substantially bulkier and less form-fitting when the same is applied to the athlete's arm and hand.

The interior surface of strap member 22 is provided with a female VELCRO fastener 24 within the vicinity of the distal end thereof, and the same is adapted to operatively cooperate with a male VELCRO fastener 26 disposed upon the right side of the exterior surface of body 12 within the central portion thereof. In a similar fashion, the interior surfaces of strap members 18 and 20 are provided with female VELCRO fasteners 28, and 30 and 32, respectively, while male VELCRO fasteners 34, and 36 and 38, are respectively provided upon the right side of the exterior surface of body 12 above and below fastener 26. The VELCRO fasteners may be secured to the glove body and strap members by any suitable means, such as, for example, a suitable adhesive, stitching, or the like, and it is to be appreciated that while the illustrated glove is to be applied to the athete's right hand, the various structural portions and members thereof may of course be simply reversed in order to fabricate a left-hand glove.

As noted hereinabove, one of the primary features of the present invention is to provide the athletic glove with means for rigidifying the athlete's wrist so as to insure the movement of the athlete's hand, wrist, and arm in unison. This is particularly crucial, for example, during bowling competition. In accordance with the present invention, the glove 10 is further provided with an additional vinyl sheet material piece 40 which is secured to the interior surface portion of glove body 12 which will overly the athlete's palm and the interior side of the athlete's arm.

Figure 3:
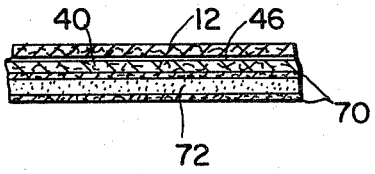
FIG. 3 is a cross-sectional view of the glove of FIG. 2 taken along the line 3—3 of FIG. 2.

As best appreciated from FIGS. 2 and 3, the material piece 40, which may be fabricated from the same material utilized in the fabrication of glove body 12, extends substantially the entire height of the glove body 12, and the same is secured to the body 12 by means of stitching 42. The stitching extends about the entire periphery of the piece 40 with the exception that the lower edge of the piece 40 is not stitched to the lower edge 44 of body 12, and in this manner, a pocket 46 is defined between piece 40 and body 12. An elongated, rigid metal brace 48, as disclosed within FIG. 4, is adapted to be inserted within pocket 46, and as will become more fully appreciated hereinafter, such a means serves to rigidify the athlete's wrist in accordance with the principles of the present invention.

Figure 6:
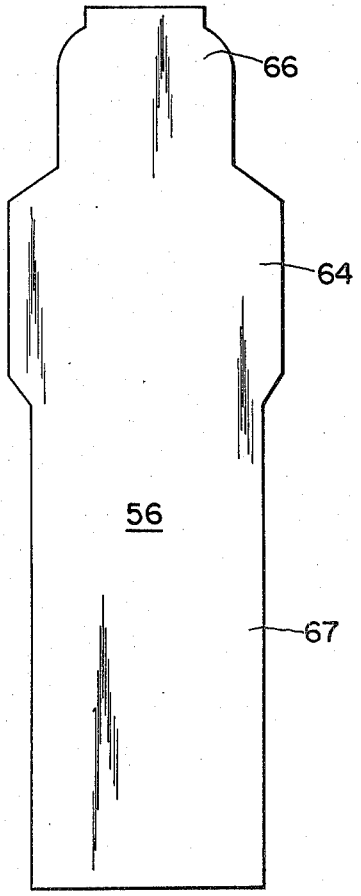
FIG. 6 is a plan view of the exterior metal brace.

A second vinyl sheet material piece 50 is secured to the interior surface portion of glove body 12 which will overly the back of the athlete's hand and the exterior side of the athlete's arm. Piece 50 may be fabricated from the same material utilized in the fabrication of piece 40 and glove body 12, and in a manner similar to that employed in conjunction with material piece 40, piece 50 may be secured to body 12 by means of stitching 52. Piece 50 extends the entire height of the glove body 12, and as best seen from FIG. 2, the stitching 52 extends about the entire periphery of piece 50 except for the vicinity of strap member 22 and the lower edge 44 of body 12. In this manner, a second pocket 54 is defined between piece 50 and glove body 12, and a second, elongated, rigid metal brace 56, as disclosed within FIG. 6, is adapted to be inserted therewithin. As will become more fully appreciated hereinafter, brace 56 operatively cooperates in conjunction with brace 48 in order to fix the disposition of the athlete's wrist in both the forward and backward directions whereby the athletic performance characteristics will be materially enhanced.

Figure 4:
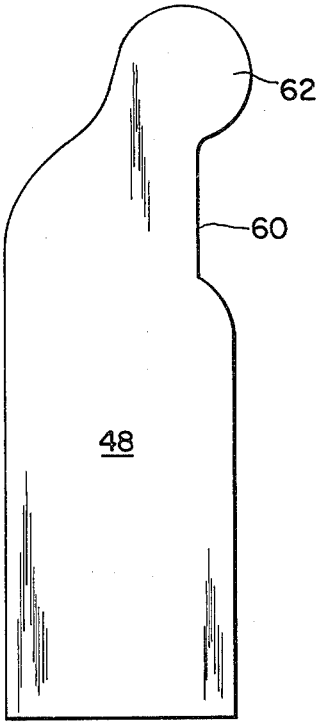
FIG. 4 is a plan view of the interior metal brace.

As may best be appreciated from FIGS. 2 and 4, the configuration of the interior metal brace 48 is similar to that of pocket 46 so as to be easily accommodated therewithin, and it is seen that the longitudinal extent of the brace 48 is such that the same will extend from the athlete's arm portion located on the side of the wrist opposite the palm to within the central portion of the hand palm. As a result, the wrist is, in effect, immobilized in the forward direction such that the hand cannot move forwardly independent of the arm. The pocket 46 includes an arcuately shaped portion 58 within the vicinity of the thumb aperture 14, and brace 48 similarly includes a cut-out section 60. Such structure permits the thumb to achieve complete and unrestricted mobility when the glove is worn by the athlete despite the presence of the metal brace 48 within the immediate vicinity. Consequently, while the athlete's wrist is immobilized, the thumb nevertheless retains complete mobility so as to achieve the desired performance characteristics during competition. In a similar manner, the uppermost portion of brace 48 comprises a flat, circular plate 62 which is adapted to be seated within the central portion of the palm when the glove is worn so as to maintain the palm flat. The fingers of the hand are therefore maintained in their natural state, and not bundled together, whereby additional mobility, flexibility, and versatility is imparted to the hand despite the restrictions imparted to the wrist.

Considering next the particular structure of the metal brace 56, and the disposition of the same within glove pocket 54, reference is made to FIGS. 2 and 6. As can be readily appreciated from FIG. 2, the longitudinal extent of pocket 54, and therefore of metal brace 56, is somewhat greater than that of pocket 46 and brace 48, respectively, for the reason that it is desired to have the exteriorly-braced portion of the glove extend over the hand knuckles and up to the first joint of the two middle fingers. In this manner, not only is the wrist prevented from moving backwardly, but in a similar fashion, the fingers are likewise prevented from experiencing such movement. It is also seen that the upper central portion 64 of brace 56 has a lateral extent substantially greater than that of the remaining portions of brace 56, and this feature, together with the longitudinal extent of the uppermost portion 66 of the brace, serves to impart substantially greater power and strength to both the finger and hand portions of the athlete's extremity. Lastly, it is to be noted that the brace 56 may be bent at the junction of the lower portion 67 thereof and the central portion 64 thereof so as to selectively dispose the athlete's wrist at a predetermined angle so as to achieve, for example, desirable ball control characteristics. The inward bending of brace 56 causes the hand to engage the interiorly braced portion of the glove with a predetermined amount of pressure, and this manner, the braced portions of the glove can achieve a greater degree of cooperation for immobilizing the athlete's wrist. The glove and braces could, of course, also be fabricated of different sizes so as to achieve proper fits upon different sized hands.

Figure 5:
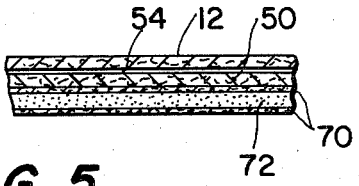
FIG. 5 is a cross-sectional view of the glove of FIG. 2 taken along the line 5—5 of FIG. 2.

In order to maximize the comfortability of the glove during competition periods, the entire interior surface of the glove is preferably covered with a quilted padded fabric 68 as disclosed in FIG. 1. With additional reference being made to FIGS. 3 and 5, it is seen that the fabric 68 is a laminate comprising inner and outer fabric sheets 70 of, for example, cotton material, and an interposed foam layer 72. The fabric 68 is secured to the interior surface of glove body 12 by means of stitching 74 provided about the entire periphery of the fabric and glove body except within the vicinity of the brace pockets. In addition, in fabricating the glove, as the VELCRO fasteners must not be covered so as to be able to operatively cooperate with each other, the female fasteners 24, 28, 30, and 32 will be secured to the fabric 68 as opposed to being directly secured to the glove body 12. It is to be further appreciated that fabric 68 will likewise prevent or minimize excessive hand perspiration, chafing, and the like.

Obviously, many modifications and variations are possible in light of the above teachings. It is therefore to be understood that within the scope of the appended claims, the present invention may be practiced otherwise than as specifically described herein.

What is claimed as new and desired to be secured by letters patent of the United States is:

1. An athletic glove comprising:

a glove body adapted to be disposed upon an arm extremity within the vicinity of the arm wrist; and means operatively associated with said glove body for positively restraining movement of said wrist with respect to and for fixing said wrist in a predetermined disposition, wherein said restraining means comprises a first rigid brace operatively engaged with the interior, palm-side of said extremity; and a second rigid brace operatively engaged with the exterior, back side of said extremity, wherein said second brace has a longitudinal extent such that the same overlies a portion of the arm of said extremity, the wrist of said extremity, and the first joint of the hand fingers, whereby when said extremity is moved through a particular motion, the hand, wrist, and arm portions of said extremity move in unison.

2. The athletic glove as set forth in claim 1, wherein:

said glove body is fabricated from planar sheet material and is adapted to be wrapped about said arm extremity;

said glove body has a substantially rectangular configuration;

said glove body has a C-shaped cut-out portion defined within one side edge thereof; and a fastening strap is integrally formed with the opposite side edge thereof for cooperating with said C-shaped cut-out portion when said glove body is disposed upon said arm extremity.

3. An athletic glove comprising:

a glove body adapted to be disposed upon an arm extremity within the vicinity of the arm wrist; and means operatively associated with said glove body for positively restraining movement of said wrist with respect to and for fixing said wrist in a predetermined disposition, wherein said restraining means comprises a first rigid brace operatively engaged with the interior, palm-side of said extremity; and a second rigid brace operatively engaged with the exterior, back side of said extremity, wherein said second brace includes a laterally widened central portion for engaging the back side of said hand so as to impart increased strength and power thereto, whereby when said extremity is moved through a particular motion, the hand, wrist, and arm portions of said extremity move in unison.

4. The athletic glove as set forth in claim 3, wherein:

said second brace is bent at the junction of said central portion and the lower, wrist-engaging portion thereof so as to impart a predetermined inclination to said wrist.

* * * * *